US005192075A

United States Patent [19]

Ashihara

[11] Patent Number: 5,192,075

[45] Date of Patent: * Mar. 9, 1993

[54] TELESCOPING GUARD BATON WITH ROTATABLE CROSS HANDLE

[76] Inventor: Hideyuki Ashihara, 360-1, 8-chome, Sanbancho, Matsuyama-shi, Ehime-ken, Japan

[ * ] Notice: The portion of the term of this patent subsequent to Oct. 23, 2007 has been disclaimed.

[21] Appl. No.: 821,884

[22] Filed: Jan. 17, 1992

Related U.S. Application Data

[63] Continuation of Ser. No. 593,716, Oct. 4, 1990, abandoned, which is a continuation of Ser. No. 394,030, Aug. 15, 1989, abandoned.

[30] Foreign Application Priority Data

Aug. 22, 1988 [JP] Japan ..... 63-209068
Mar. 27, 1989 [JP] Japan ..... 1-75529

[51] Int. Cl.[5] ..... F41B 15/02
[52] U.S. Cl. ..... 273/84 R
[58] Field of Search ..... 273/84 R, 84 ES, 67 R, 273/81 A, 81 C, 81.2, 80 D; 74/551.9; 362/102

[56] References Cited

U.S. PATENT DOCUMENTS

| | | | |
|---|---|---|---|
| 1,842,922 | 1/1932 | Frantzius | 42/1.16 |
| 2,391,782 | 12/1945 | Hutchinson | 273/84 |
| 3,716,170 | 2/1973 | Mangels | 222/162 |
| 4,037,839 | 7/1977 | Nelson | 273/84 R |
| 4,109,912 | 8/1978 | Zertmyer | 273/84 |
| 4,132,409 | 1/1979 | Taylor | 273/84 |
| 4,203,599 | 5/1980 | Starrett | 273/84 |
| 4,403,787 | 9/1983 | Shimano | 74/551.9 |
| 4,479,171 | 10/1984 | Mains | 362/102 |
| 4,694,981 | 9/1987 | Miller, Jr. | 224/251 |
| 4,739,990 | 4/1988 | Aguirre et al. | 273/84 |
| 4,752,072 | 6/1988 | Parsons | 273/84 R |
| 4,964,636 | 10/1990 | Ashihara | 273/84 R |

FOREIGN PATENT DOCUMENTS

| | | |
|---|---|---|
| 0831626 | 6/1938 | France . |
| 1287775 | 2/1962 | France . |
| 2491719 | 10/1980 | France . |

OTHER PUBLICATIONS

"Dick Tracy" (Comic Strip); Washington Post; May 31, 1970.

*Primary Examiner*—V. Millin
*Assistant Examiner*—William M. Pierce
*Attorney, Agent, or Firm*—Nikaido, Marmelstein, Murray & Oram

[57] ABSTRACT

A crosshandled guard baton which comprises a hollow club and a crosshandle which is branched thereon at a place toward a club end. The inventive guard baton is featured in accommodating at least one slender cylindrical member in the hollow space of the club, in retracted form usually, thereby so saving in the point of space or length needed to be carried by a user, and in case of need, this retracted member can extend telescopically out of the club end to form a kind of pseudo-sword, hence so convenient to the police or guard personnel.

12 Claims, 16 Drawing Sheets

TELESCOPING GUARD BATON WITH ROTATABLE CROSS HANDLE

This application is a continuation of application Ser. No. 593,716 filed Oct. 4, 1990, now abandoned, which is a continuation of application Ser. No. 394,030, filed Aug. 15, 1989, now abandoned.

FIELD OF THE INVENTION

This invention relates to a guard baton or police billy or the like. Particularly, this relates to a crosshandled guard baton.

DESCRIPTION OF THE CONVENTIONAL ART

The term "crosshandled guard baton" is intended to indicate a guard baton which has a short handle branchedly secured on a main club body at a biased place or midpoint between an end and a central portion of the club length. A guard baton of this type is described in U.S. Pat. No. 4,132,409 which has been only the sole conventional art according to the inventor's knowledge.

In this U.S. Patent, the handle is axially divided to two portions, stationary and rotatable, and the description therein teaches that the stationary one is put into motion when rotating or swinging of the club is intended. However, in view of the fact that it is not determinable whether the crosshandle is gripped by the right hand or the left hand of a baton user, and also probable is a change of gripping this handle from the right hand to left or vice versa, thus, a device for braking the rotating club should be improved to be more convenient to prepare for gripping by an either hand. This was the starting point of this invention and, in addition thereto, new devices are introduced to the present inventive baton as the description herein will make them apparent in the following.

On the other hand, KARATE, a kind of sports or practice for combat without a hand weapon, has become popular in the world and such a combat practice is sometimes used by an assailant to the police or security personnel, and therefore, those who are entitled to wear such a guard property as a baton are desirous that their guard property be improved, in particular, be improved so as to realize KARATE actions on an enlarged scale, to which purpose a rotatable crosshandled baton is basically appropriate and improvement in the braking device with a guard baton is suited, because in KARATE techniques wielding of two hands is important, but at the same time, a quick stop of a hand action is necessary to make use of the foot to kick or to add an attack by footwork. In connection with the crosshandled guard batons, two U.S. patent applications have been filed by the present inventor with the following identifications: Ser. Nos. 312,988 and 313,003, both filed on Feb. 21, 1989. In contrast to these previous inventions, this invention makes improvement relative to longitudinal extensibility of the guard baton as will be apparent later.

SUMMARY OF THE INVENTION

This invention is generally summarized as featuring a crosshandled guard baton which comprises a club having a longitudinal axis and a crosshandle transversely branched on the club at a biased place toward a club end, wherein the crosshandle (the term "crosshandle" will often be abbreviated to "handle" in the following) has a branching lenght comparable to a breadthal length or width of a man's hand palm and is typically defined by three portional members of a lower grip, central grip and upper grip which are laid or stacked on one another to form a upright stand on a mounting base formed on the club, and the handle is preferred to have an elliptic shape in section, of which major axis is conformed to the club axis. Turning to internal structures of the handle, a longitudinal shaft, typically connection of a few segments, is secured on the mounting base and is extended to reach through an outer end of the upper grip, and the shaft is rotatably supported with the lower and upper grip members while the central grip is fastened to the shaft such that the club is turnable around the handle with a concurrent motion of the central grip, hence keeping the lower and upper grips in independence of the motion with the club and central grip. Further, the handle is modified to dispense with the rotatable lower grip from the rest of the members defining the handle.

Further, the present invention is particularly directed to the guard batons in provision of at least one telescopically extensible pipe or cylindrical member which is usually accommodated in a hollow space provided in the club body.

Figure 1:
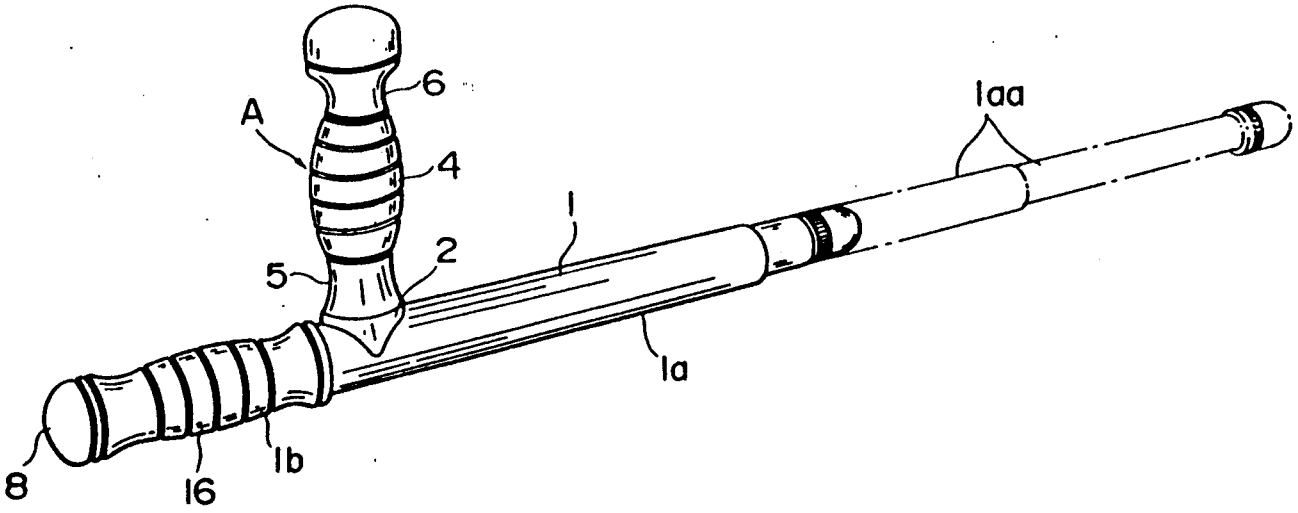
FIG. 1 is a perspective view of an embodiment of the present invention.

These drawings are presented to illustrate the invention and therefore these should not be construed as limiting the invention. And in the drawings, a like numeral indicates a like part, and a length of the club is sometimes shortened out of scale without a cut mark and such should not be construed to destroy the invention.

DESCRIPTION OF THE EMBODIMENTS

With reference to FIGS. 1, 2, 11, and 12, the numeral 1 is a club having a longitudinal axis. A is a crosshandle having an axis which is substantially upright to the club axis or transversely branched on the club 1 at a biased place toward a club end. For convenience, the club length is divided at the place of a base 2 for mounting the handle A into two portions of 1*a* for long or shank portion and 1*b* for short or hilt portion. And said handle A has a length comparable to a breadthal length or width of a man's hand palm and is typically defined by three portional members of a lower grip 5, central grip 4, and upper grip 6 which are laid or stacked on one another with inter-slidability to form an upright stand on the mounting base 2 formed on the club 1, and internally of the handle, a longitudinal shaft 3, typically connection of a few segments, is secured on the base 2 and is extended to reach through an outer end of the upper grip 6, and the shaft 3 is rotatably supported with the lower and upper grips 5, 6 while the central grip 4 is fastened to the shaft 3 such that the club 1 is turnable around the handle A with a concurrent motion of the central grip 4, hence keeping the lower and upper ones 5, 6 in independence of a rotary motion of the club and central grip. In this connection, the grip members 5, 6 are sometimes noted "rotatable grip members" in the following.

Reference is added to general explanation of these drawings, the numerals 9, 10 are sleeves inserted between the shaft 3 and inside the grip members 5, 6. And 8 is a plug which seals an end opening of the club at the hilt portion. 16 is a grip cover which is attached on the hilt portion. 1*aa*, drawn in virtual lines, is an extended portion of the club as will be apparent in later.

In the above, where to place the handle A is meant by "a biased place toward a club end", however, it is recommended to determine the biased place so that the hilt portion 1*b* may have a length comparable to the longitudinal length of the handle A.

Figure 11:
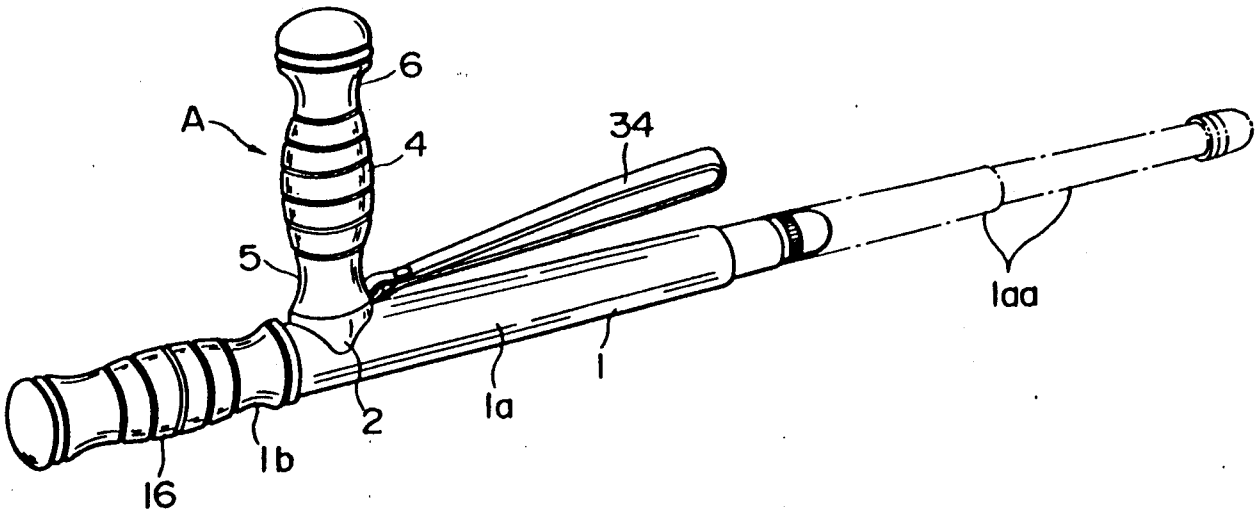
FIG. 11 is a perspective view of another embodiment of the present invention featuring in addition of a strap band as is seen.

In use of a guard baton as a pseudo-sword with the hilt portion gripped, the handle A may act as a cross guard of a sword. In FIG. 11, the numeral 34 is a strap band for hitching a user's hand to secure the gripping.

As for material to manufacture the inventive guard batons, any hard material is available; wood, plastic, light metal or iron. Of them, wood or reinforced plastic is most suited.

Figure 2:
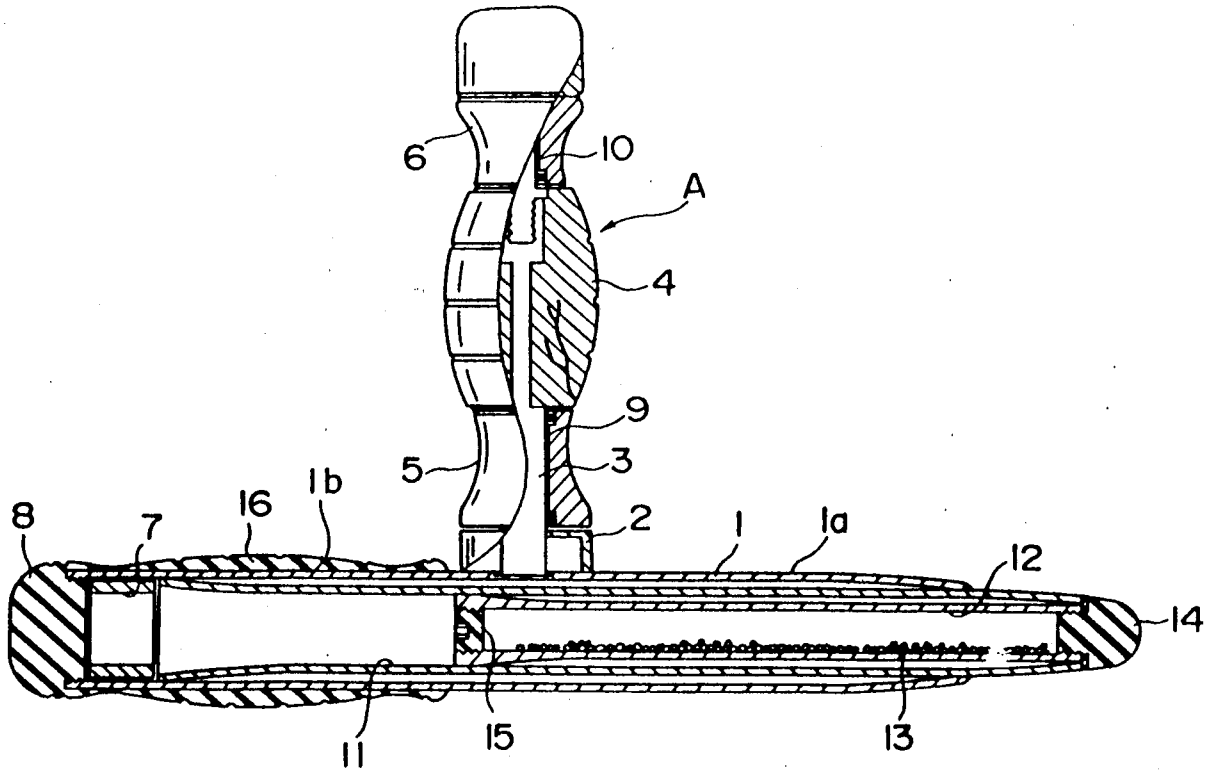
FIG. 2 is a front view of the embodiment shown in FIG. 1 with a break to show internal structures.

Turning to explanations of the drawings as a whole, reference to devices accommodated in the club 1 in FIG. 2 is made as follows: Interior of the club 1 in this instance is one through space, not divided, and in making use of the interior space, accommodated are a plurality of slender cylinderical members 11, 12 in retracted form which are extensible telescopically to form the portion like the one 1*aa* shown in FIG. 1, wherein the member 11 having a larger diameter than the other member 12 is shaped to be radially expanded at its end placed to be close to the plug 8 and to be radially contracted at its end placed to be a slightly out of an open end of the club 1 to form a subtle taper forward as a whole, and a base end of the member 11 is abutted at a buffer member 7 located inside the plug 8, and thereinside an inner or core member 12 is so inserted as, for its outer periphery of forward end, to be fitted tightly with the end of the enclosing outer-member 11, and a forward opening end of the member 12 is plugged with a cap 14, and a base or butt end of the inner member 12 is reinforced by a plug 15.

These retracted members 11, 12 will be extended by action of centrifugal force, when the club is gripped at the club hilt 16 by a user and put into a swing motion, for instance, wherein tight fittings of the member 11 to the member 12 and also of the member 11 to inside face of the club 1, with aid of the tapering as noted, is helpful to form a kind of reduced coupling, hence to avoid an unexpected easy extension or slip-out due to a small force, and therefore adequate tight fittings are necessary.

In FIG. 2, 13 is a weight which is comprised of metallic beads or particles, which will accelerate the centrifugal force.

Note: In the following, new embodiments will be described, but therein, without repeating the same, descriptions will be mainly directed to new other features than those which were already noted in connection with the preceding drawings.

Figure 3:
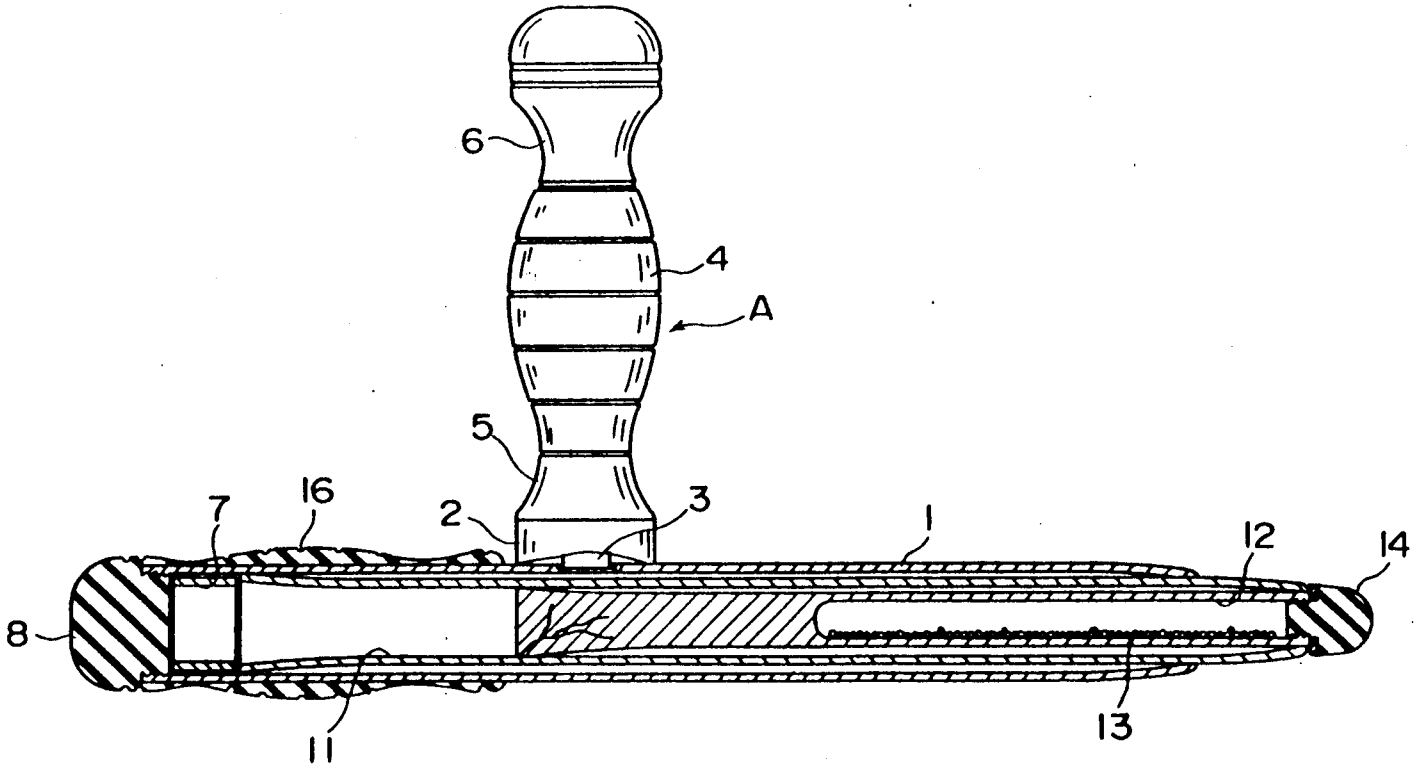
FIGS. 3 to 10 are front views of several embodiments with breaks to show respectively various internal structures.

With reference to FIG. 3, new features are mainly in that the core cylinder 12 has partly a space wherein a weight 13 composed of particles is received.

Figure 4:
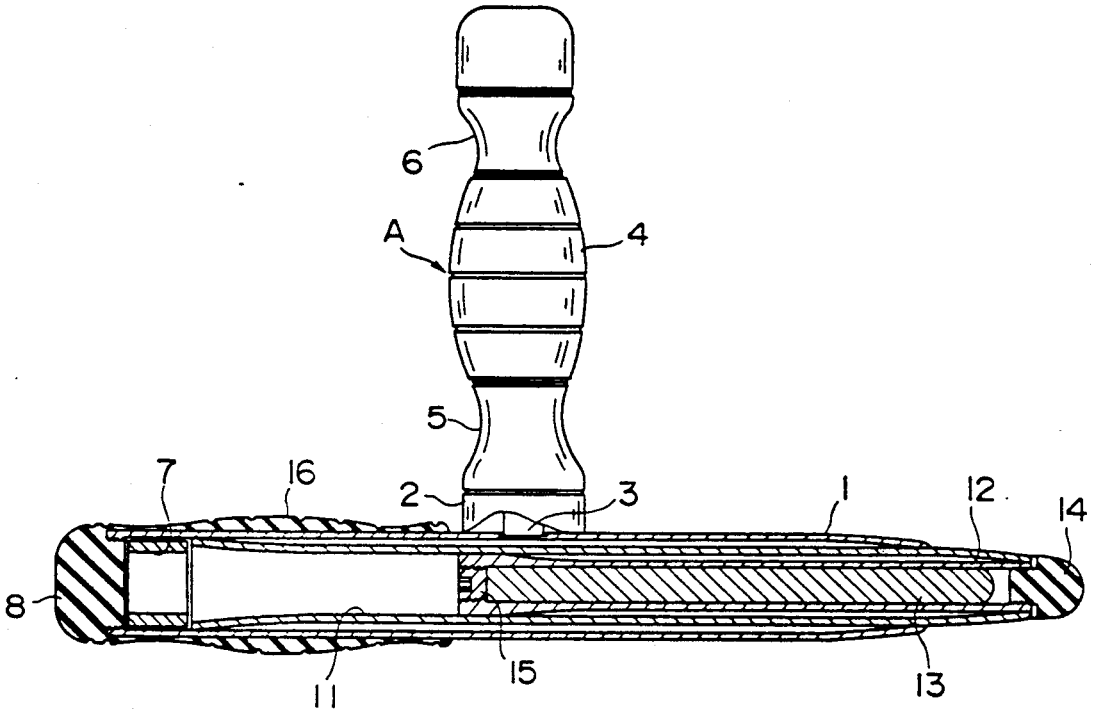

With reference to FIG. 4, the weight 13 is, instead of beads, a solid metal which is packed in interior of the core cylinder 13, and other features may be regarded as being much the same as in the preceding example.

Figure 5:
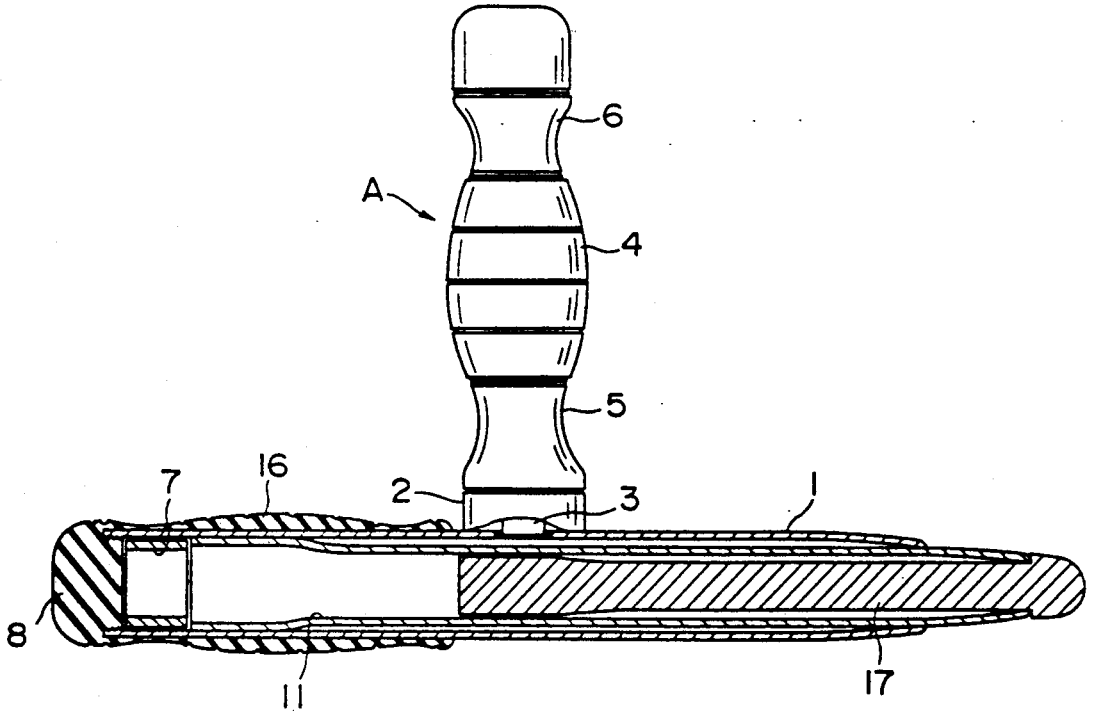

With reference to FIG. 5, the core member 13 is made of a kind of metal, that is, the member 13 itself is a weight.

Figure 6:
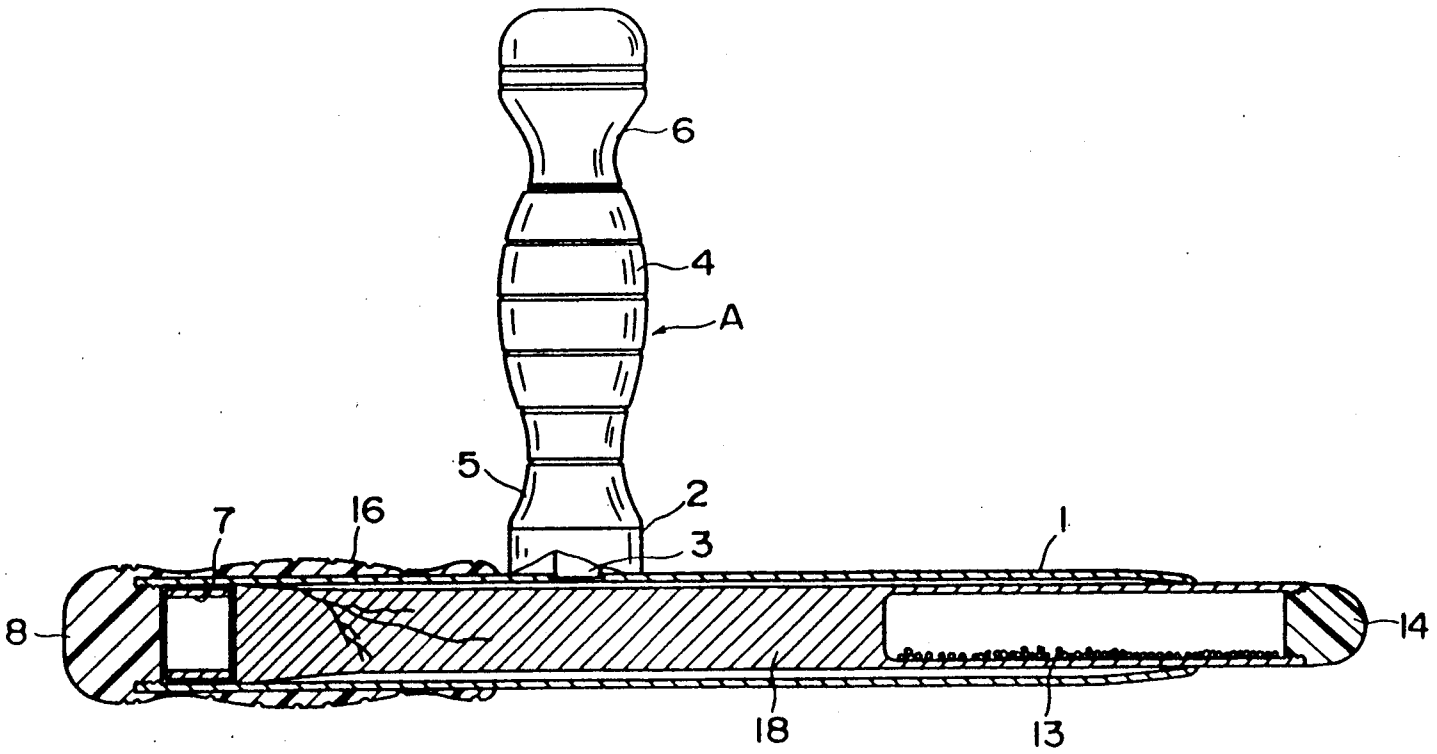

With reference to FIG. 6, the cylindrical members in the preceding example are simplified to be one metal-made member 18 having a partial interior space in which a weight 13 is received.

Figure 7:
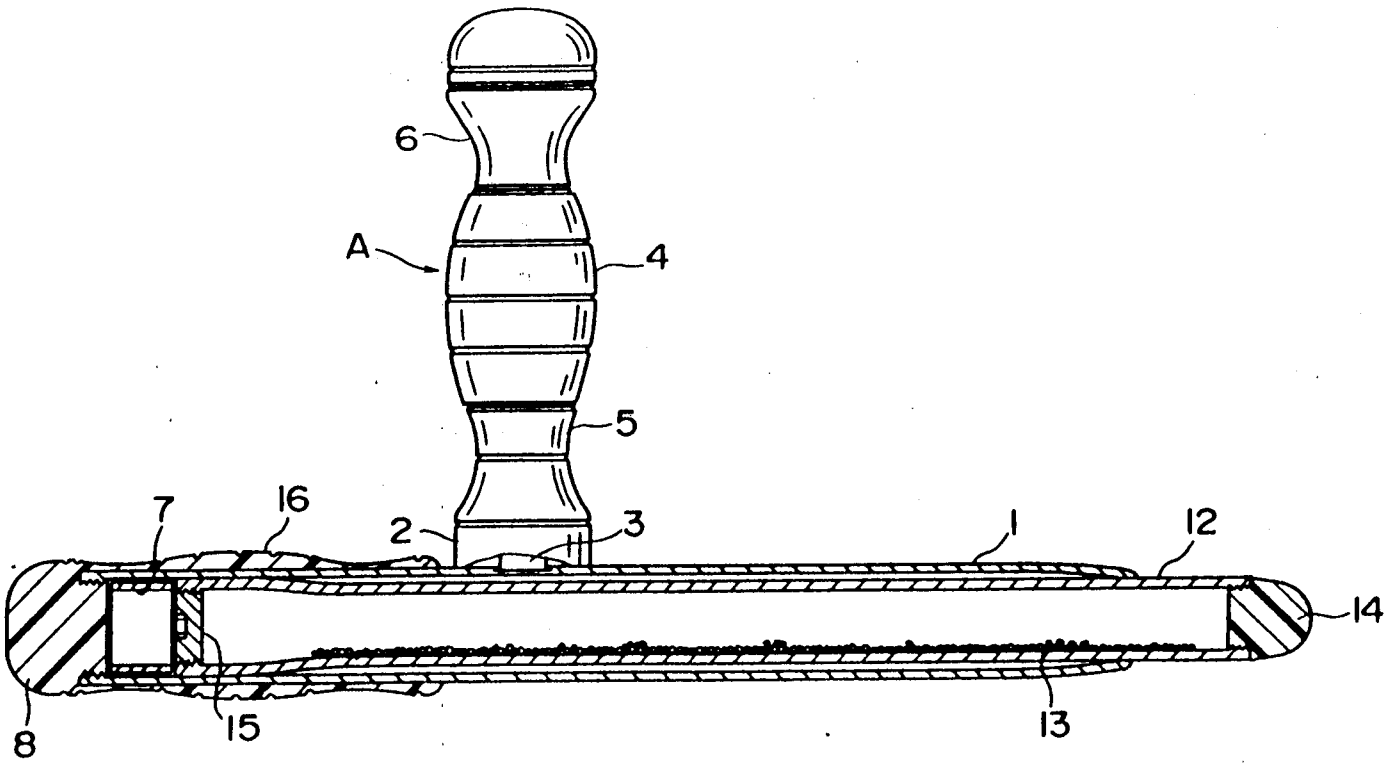

With reference to FIG. 7, one cylindrical member 12 employed is one having a length comparable to the whole length of the club 1 and having a through space, in which a weight 13 is received.

Figure 8:
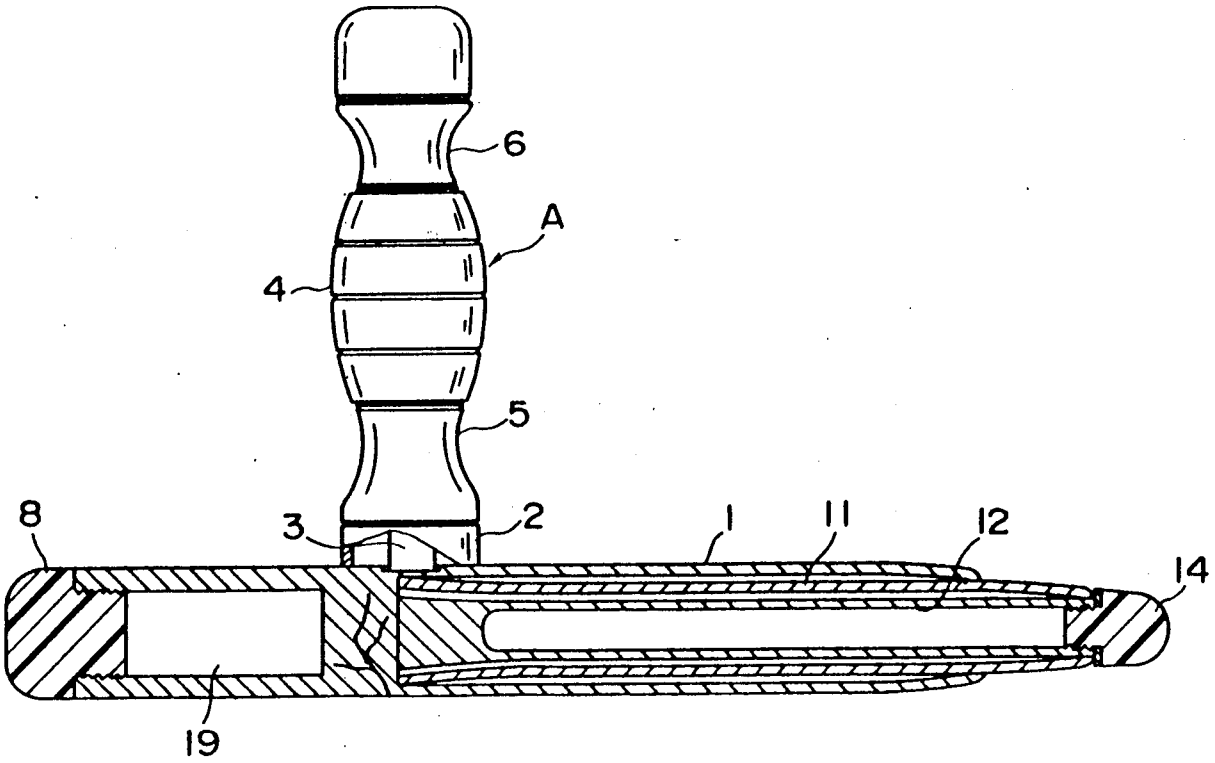

With reference to FIG. 8, the cylindrical member 11 is shortened to be comparable to a length of the shank portion 1*a* and the interior of the club 1 is divided to two spaces wherein the hilt space 19 is left as a cavity, which may be used to store personal properties.

Figure 9:
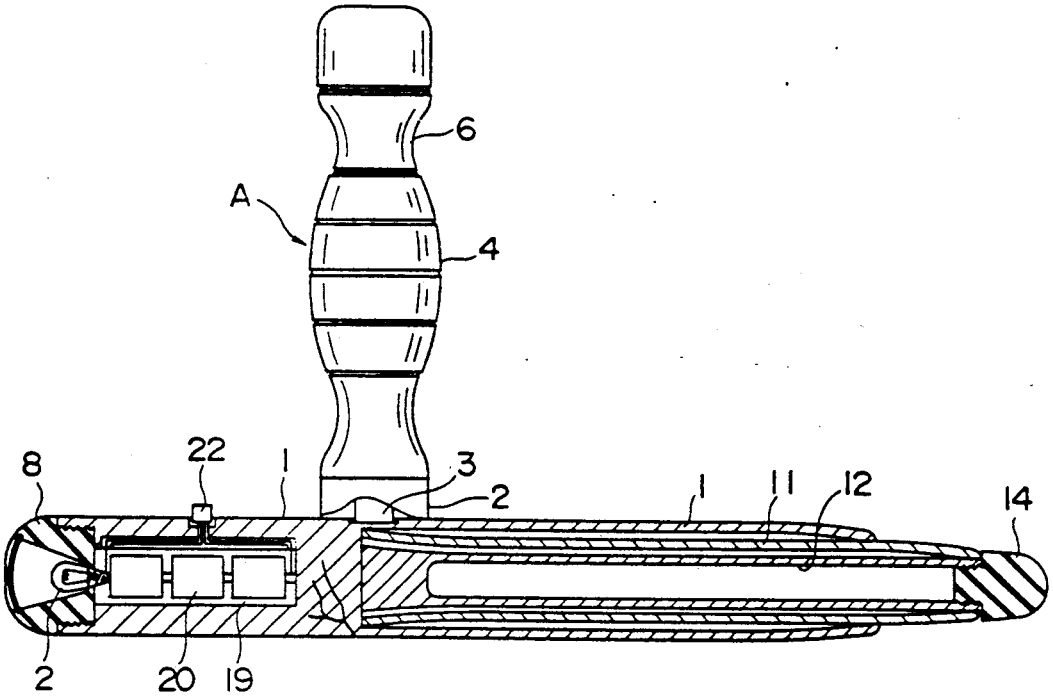

With reference to FIG. 9, the arrangement for extensible members is much the same as in FIG. 8, and in the space 19 accommodated is a lightening or illuminating device, wherein 20 is a battery, 21 is a lamp, 22 is a manual on-off switch.

Figure 10:
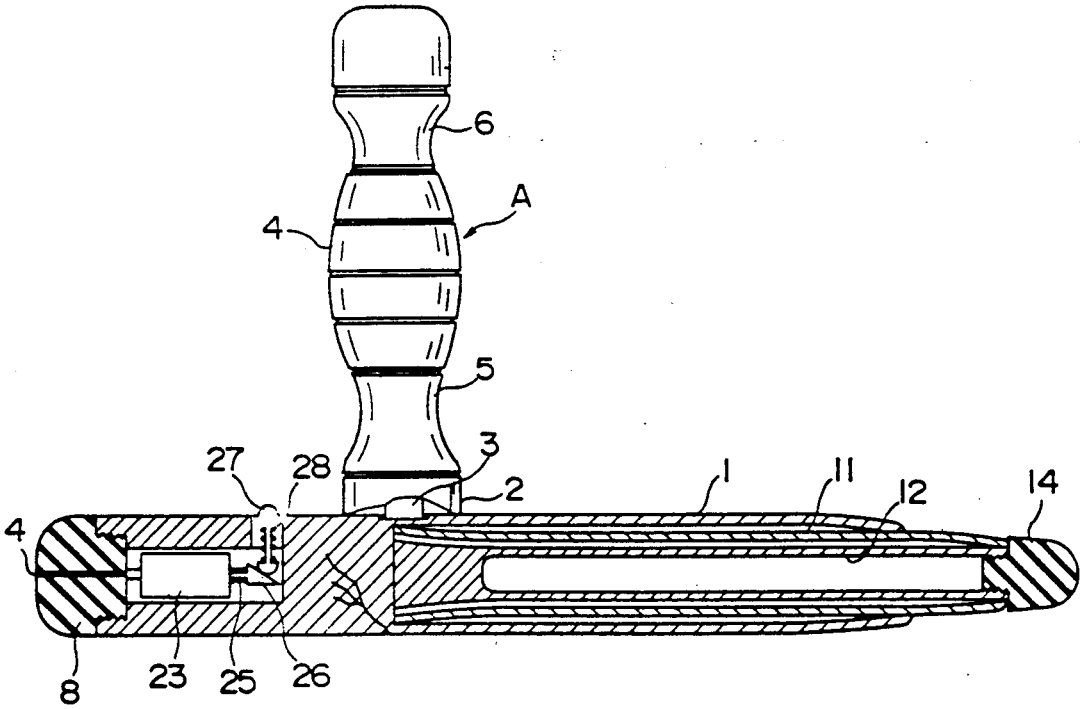

With reference to FIG. 10, the arrangement for the lightening device in FIG. 9 is replaced with a gas ejecting device, wherein 23 is a gas bomb, 24 is an opening of a pipe for gas ejection, 25 is a ram, 26 is a ram head, 27 is a trigger button, and 28 is a spring to urge the trigger rod.

Figure 12:
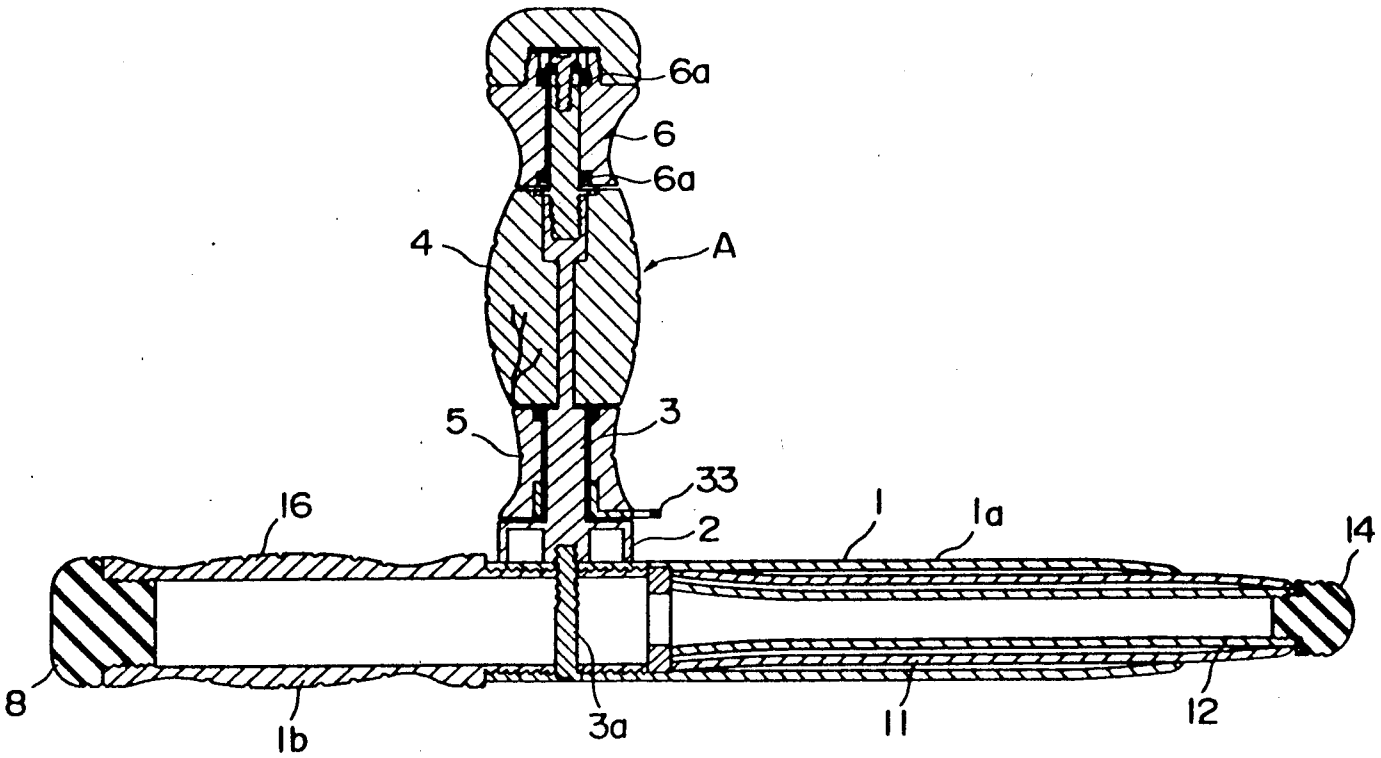
FIGS. 12 to 18 are front views of different embodiments with sections or partial sections (or breaks) to show respectively various internal structures.

With reference to FIG. 12, the handle A is secured to the club 1 by screw engagement of a king pin 3*a* which extends across the club 1 to thread into a tapped bore 29 located at the bottom of the shaft 3, and a hook 33 is added around the base of the handle A to hook a strap band 34.

Figure 13:
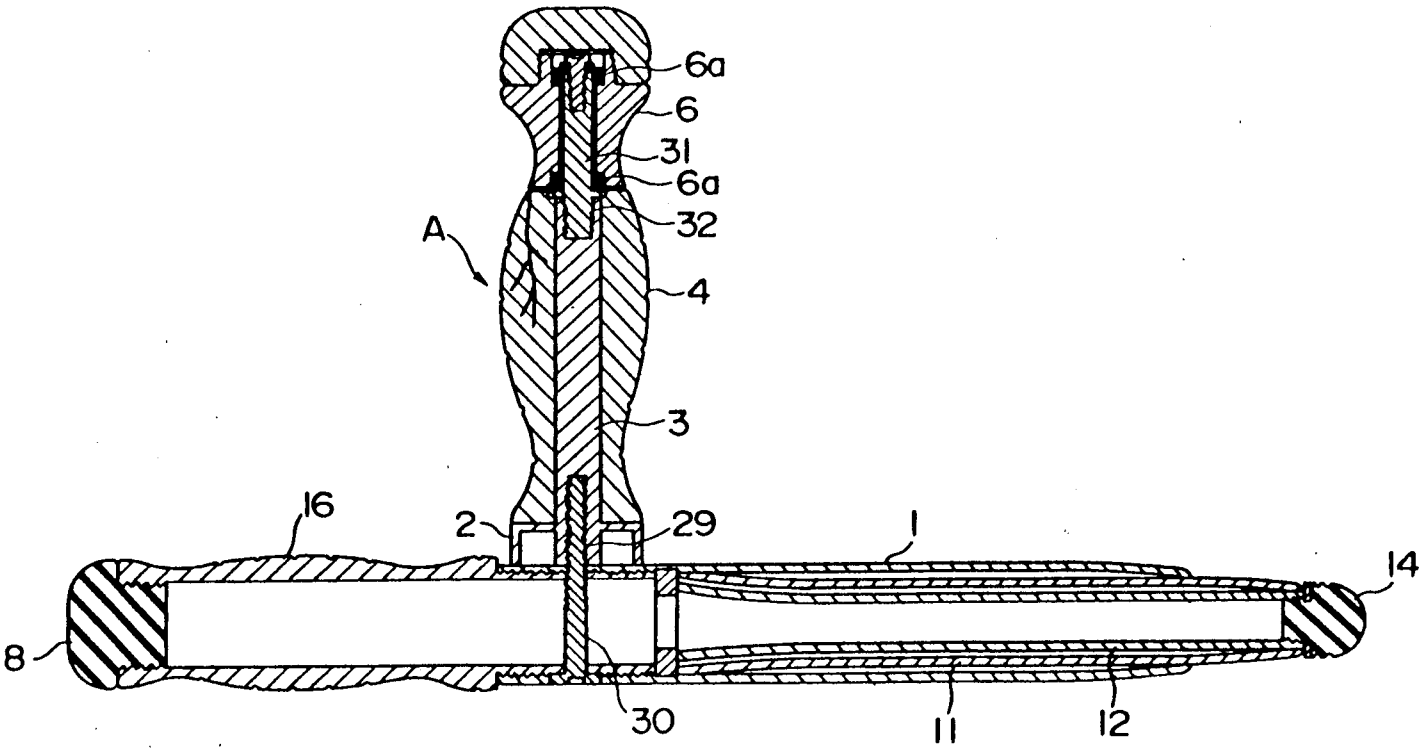
Figure 14:
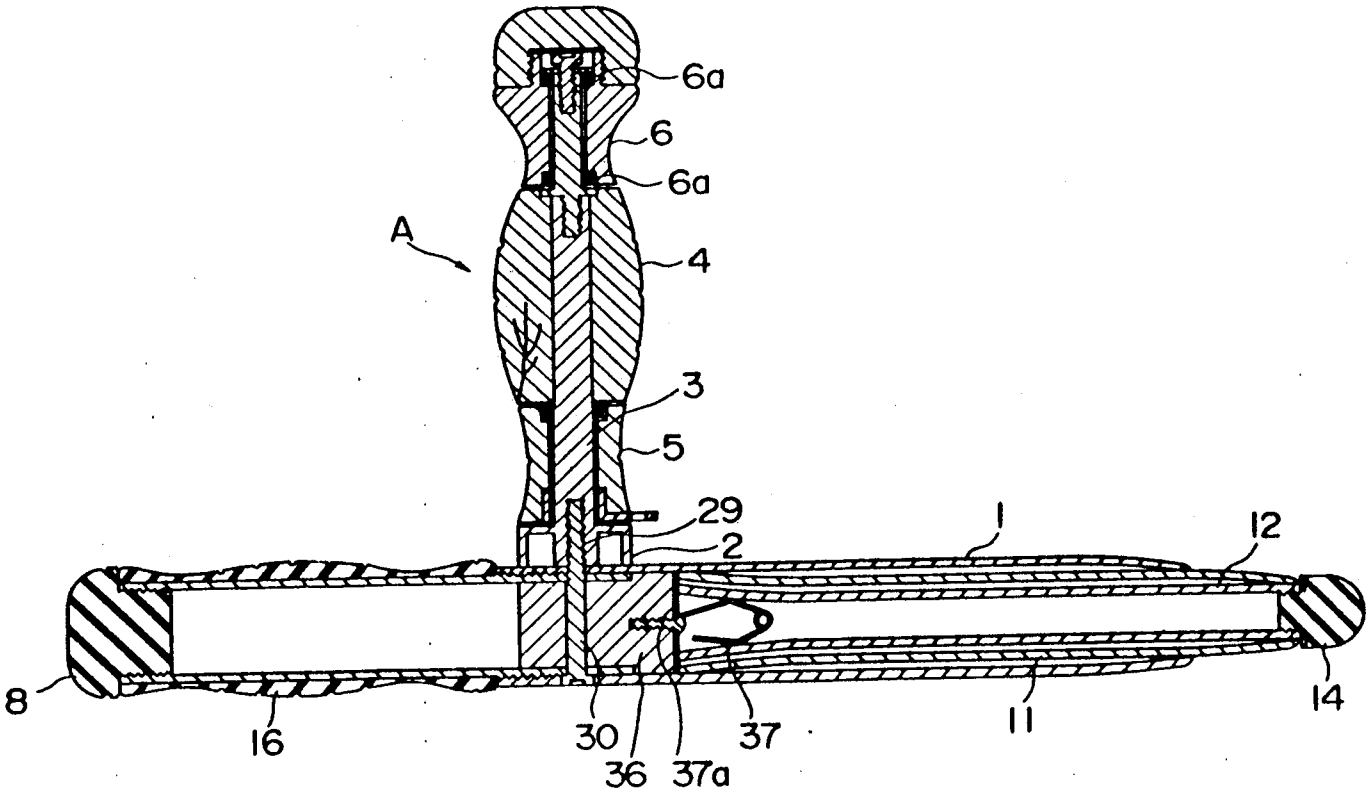

With reference to FIG. 13, the handle A is structured with two grip members, main grip 4 and upper grip 6 with one rotatable member 6. With reference to FIG. 14, the cylindrical members 11, 12 are much the same as in FIG. 13, and a new part 36, named a reinforcing member, is introduced which is located in alignment to the king pin 30. The member 36 has a through bore for the pin 30 and also a spring 37 as shown to press the inside of the core cylinder 12 by urging action of the spring so that a let-off of the core cylinder 12 may be controlled, and the spring 37 may be set to be removable by mounting it by means of thread engagement as shown.

Figure 15:
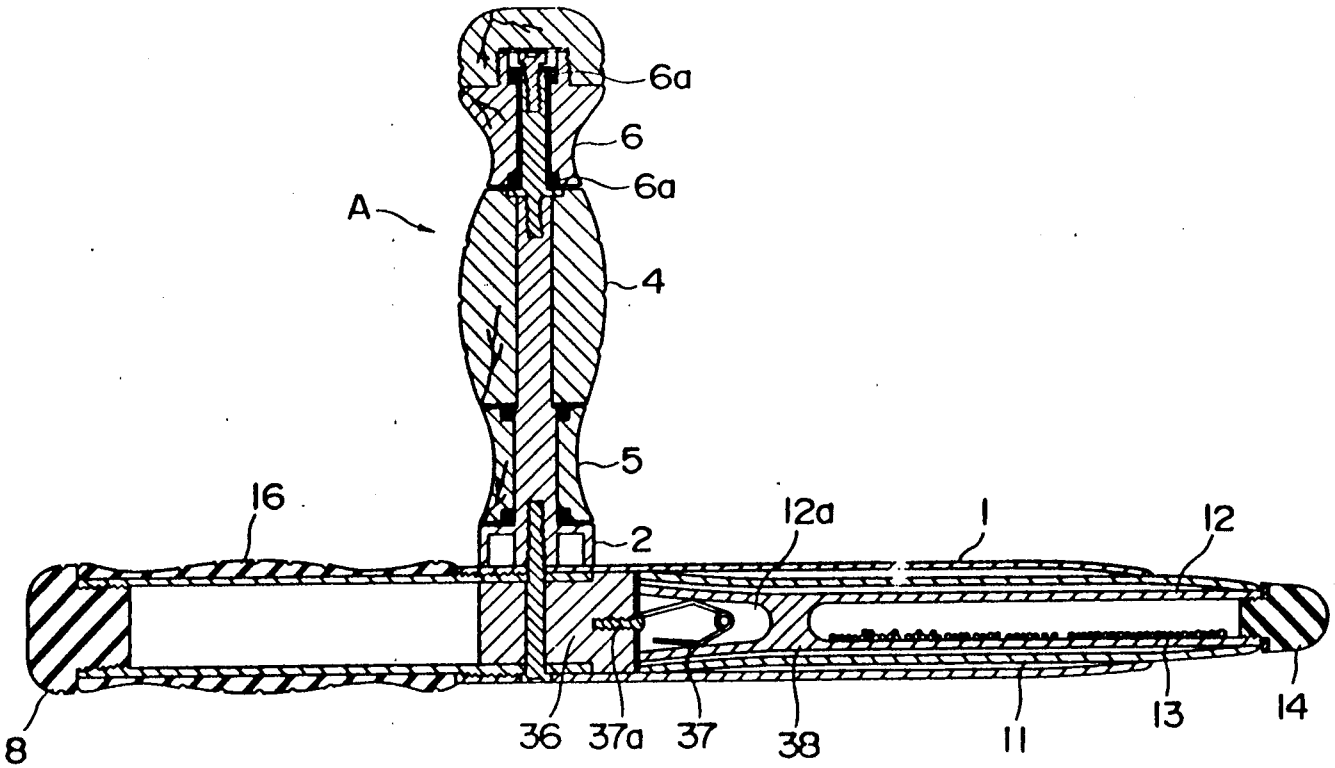

With reference to FIG. 15, the inner space of the core member 12 is divided to two partitions, one of which is employed to receive a weight 13 and the other 12*a* is used to receive a spring 37. In applying the spring 37 in a few examples shown in the preceding drawings, inner face of the partition 12*a*, that is, tip portion of the member 12 is preferable to be contrived to curve open or close so as for the spring 37 to be clamped more strongly.

Figure 16:
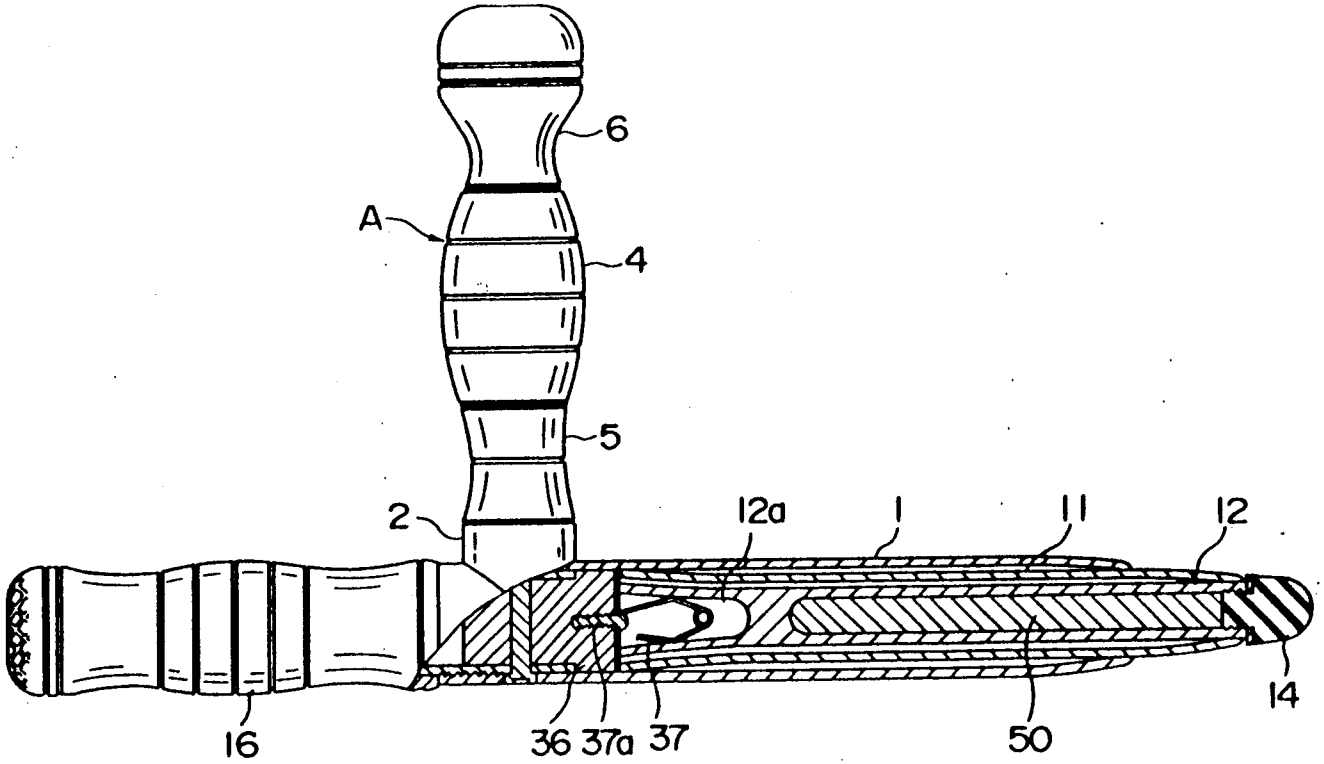

With reference to FIG. 16, in a similar way, the inner space of the core member 12 is divided to two partitions, one of which is employed to receive a solid metal weight 50, in place of metal particles in the preceding example.

Figure 17:
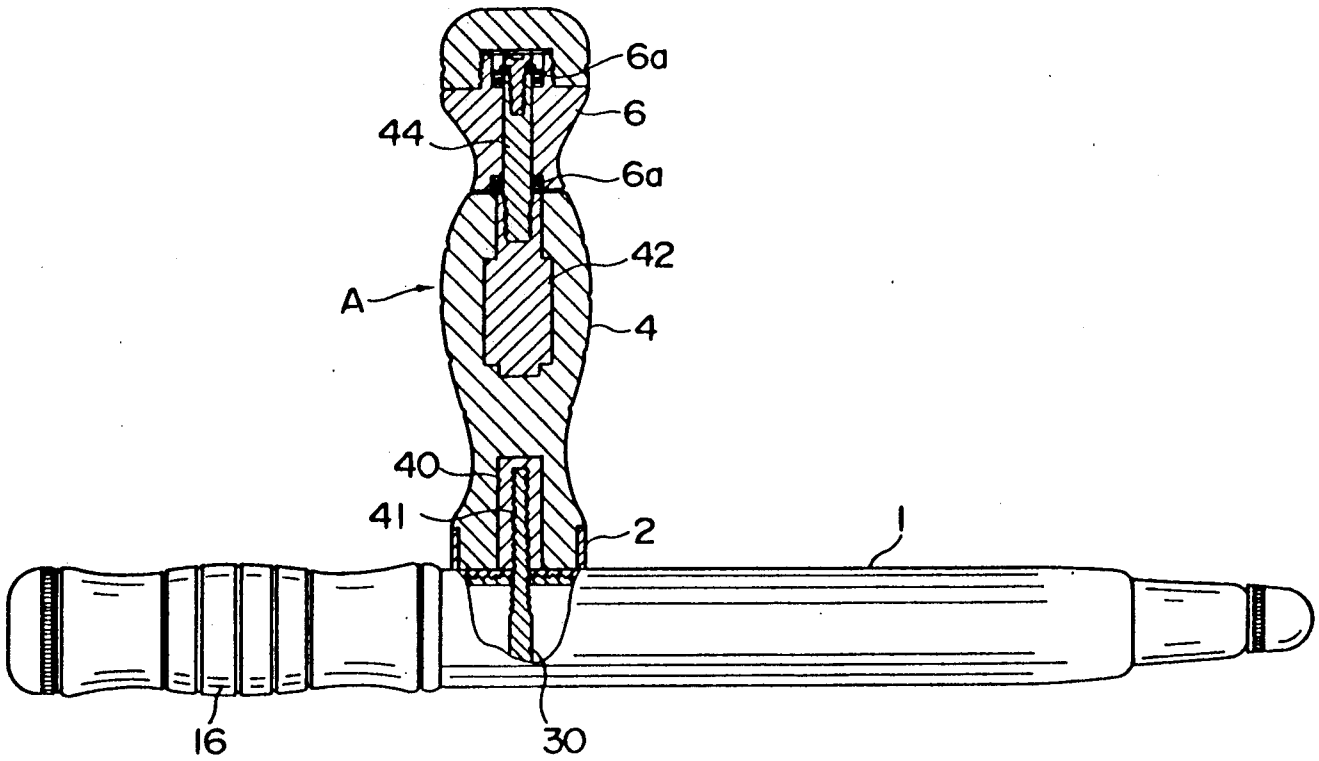

With reference to FIG. 17, the mounting base 2 is transformed to be a concave upward in section to receive the bottom of the main grip 4 and one rotatable grip 6 is incorporated in the handle A, wherein a member 40 is inset in the bottom face of the main grip 4 for tapping engagement 41 with the pin 30, and a member 42 is also inset in the top face of the main grip 4 to receive a shaft 44 with thread engagement, around which bearings 6a, 6a are mounted for making the grip 6 rotatable.

Figure 18:
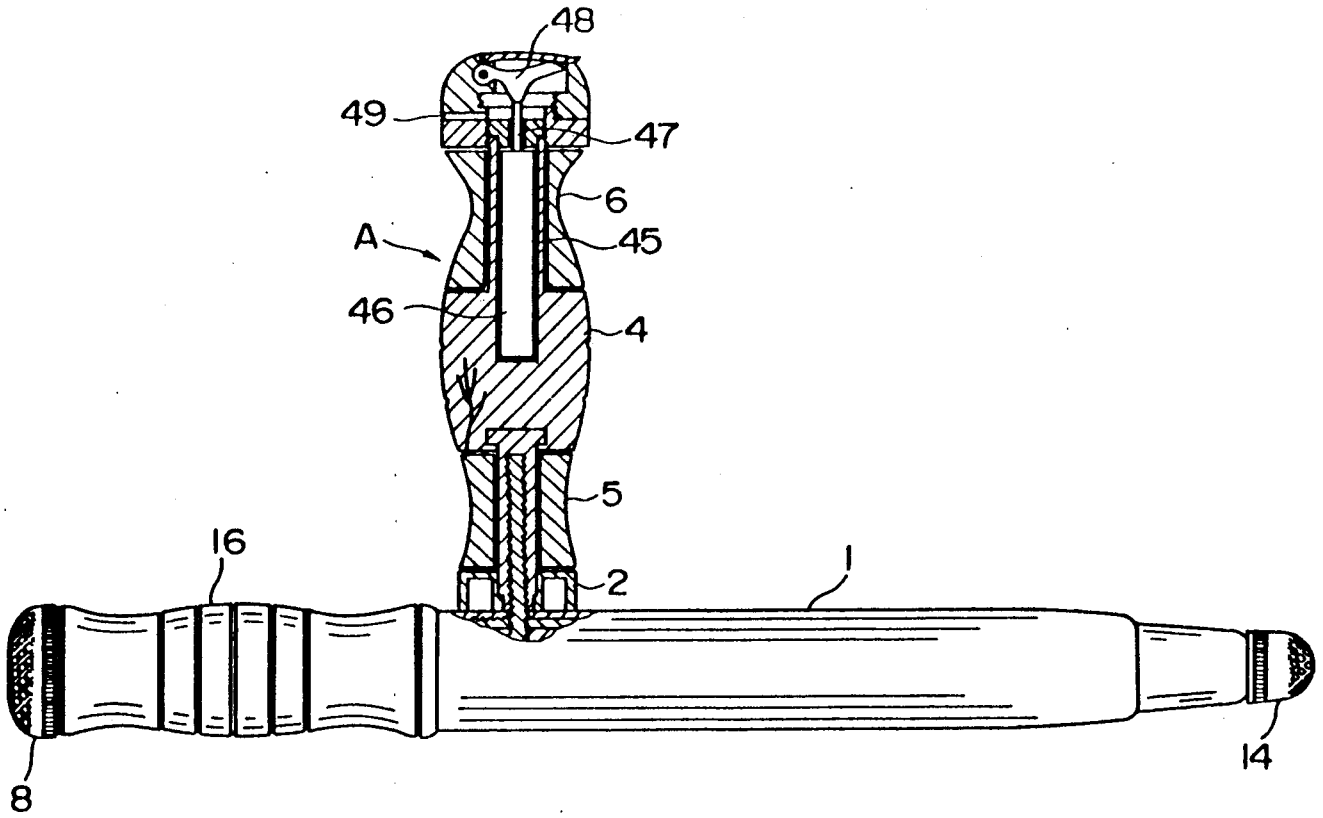

With reference to the FIG. 18, a gas ejecting device is incorporated in an upper portion of the handle A. Specifically, 45 is a recess to accommodate a gas bomb 46, which is inset therein, 47 is a nozzle for ejection, 48 is a pivotal lever to act as a trigger, and 49 is a hole to let off the gas.

As is understood from the descriptions so far, the inventive guard baton is retractile and thereby so saving in the point of space or length needed to be carried by a user, and in case of need, this can extend to form a kind of pseudo-sword, hence so convenient to the police or guard personnel.

What is claimed is:

1. A crosshandled guard baton which comprises:

a club having a hollow cylindrical form open at one end;

a crosshandle perpendicular to the club and supported internally by a shaft secured to said club at a position toward one end of said club, said crosshandle having a length substantially equal to the width of a man's palm;

the crosshandle comprising three portional members consisting of an upper, a central and a lower portional member which are stacked on one another with said lower portional member adjacent said club and a slide plane between adjacent portional members, said upper and lower portional members being rotatably supported by said shaft such that the club and said central portional member are rotatable relative to said upper and lower portional members;

at least one diametrically smaller cylindrical member telescopically received internally of the hollow space of the club and having one end extending out of said open end of the club, said at least one diametrically smaller cylindrical member being tapered radially inward at said end extending out of said open end of the club and tapered radially outward at a second end so as to be slidable internally of said club, whereby said at least one diametrically smaller cylindrical member is slidably movable relative to said open end of said club to extend outward of said open end of said club by a swing movement of said club and said radially outward tapered second end is retained internally of said open end of said club.

2. A crosshandled guard baton as defined in claim 1, wherein the crosshandle is located at a position on the club dividing the club length into two portions comprising a long portion and a short portion and said short portion has a length substantially equal to an upright length of the crosshandle.

3. A crosshandled guard baton as defined in claim 1, wherein the club is radially inwardly tapered toward said open end and telescopically receives two diametrically smaller cylindrical members and each diametrically smaller cylindrical member is tapered to be radially expanded at its end spaced from the open end of the club and radially inwardly tapered at its end close to the open end of the club whereby each diametrically smaller whereby each diametrically smaller cylindrical member is movable by said swing movement to extend telescopically outward of said open end of said club and said radially outward tapered end of said diametrically smaller cylindrical member is retained internally of a radially inward tapered outer surface.

4. A crosshandled guard baton as defined in claim 2 or 3, wherein each of said cylindrical members has a length substantially equal to the long portion of said club.

5. A crosshandled guard baton as defined in claim 4 or 3, wherein each of said cylindrical members has a length substantially equal to the length of the club.

6. A crosshandled guard baton as defined in claim 2 or 3, wherein a cylindrical member has a hollow internal space and a weight is provided in said hollow space in the form of a plurality of particles.

7. A crosshandled guard baton as defined in claim 4 or 3, wherein a cylindrical member carries a weight of solid metal.

8. A crosshandled guard baton as defined in claim 1, wherein the crosshandle is secured to the club by a pin which extends across the hollow interior of the club and is set positionally in alignment to the crosshandle, and a spring secured to the pin projecting internally of said diametrically smaller cylinder presses radially outward on an inside face of the cylindrical member to resist movement of the cylindrical member when first subjected to a centrifugal force.

9. A crosshandled guard baton as defined in claim 1, wherein an opening at one end of said club is sealed by a plug.

10. A crosshandled guard baton as defined in claim 1, wherein a gas ejecting device is provided internally of the crosshandle.

11. A crosshandled guard baton as defined in claim 1, wherein the crosshandle has an elliptic section and a major axis of said elliptic section is substantially aligned with a longitudinal axis of the club.

12. A crosshandled guard baton as claimed in claim 1, wherein said upper portional member is formed with a surface contour comprising a first portion of gradually reducing diameter extending outwardly from said central portional member and a second portion of gradually increasing diameter blending with said first portion to provide a finger gripping recess in said upper portional member at an outer end of said central portional member.

* * * * *